US006592260B1

(12) United States Patent
Randall et al.

(10) Patent No.: US 6,592,260 B1
(45) Date of Patent: Jul. 15, 2003

(54) FLEXIBLE STORAGE BAG WITH AUDIBLE CLOSURE INDICATOR

(75) Inventors: Catherine Jean Randall, Cincinnati, OH (US); Matthew Todd Hupp, Cincinnati, OH (US); Beverly Julian Jackson, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/642,509

(22) Filed: Aug. 18, 2000

Related U.S. Application Data

(60) Provisional application No. 60/150,028, filed on Aug. 20, 1999, provisional application No. 60/150,029, filed on Aug. 20, 1999, and provisional application No. 60/150,030, filed on Aug. 20, 1999.

(51) Int. Cl.[7] ..... B65D 33/16

(52) U.S. Cl. ..... 383/64; 24/399; 24/400

(58) Field of Search ..... 383/63, 64; 24/399, 24/400

(56) References Cited

U.S. PATENT DOCUMENTS

| | | | | |
|---|---|---|---|---|
| 4,736,496 A | | 4/1988 | Fisher et al. | |
| 4,905,298 A | | 2/1990 | Walor | |
| 5,070,584 A | | 12/1991 | Dais et al. | |
| 5,138,750 A | | 8/1992 | Gundlach et al. | |
| 5,140,727 A | | 8/1992 | Dais et al. | |
| 5,403,094 A | | 4/1995 | Tomic | |
| 5,518,801 A | * | 5/1996 | Chappell et al. | 428/152 |
| 5,611,627 A | | 3/1997 | Belias et al. | |
| 5,647,100 A | | 7/1997 | Porchia et al. | |
| 5,650,214 A | * | 7/1997 | Anderson et al. | 428/152 |
| 5,669,715 A | * | 9/1997 | Dobreski et al. | 383/64 X |
| 5,722,128 A | | 3/1998 | Toney et al. | |
| 5,774,955 A | | 7/1998 | Borchardt et al. | |
| 6,074,096 A | * | 6/2000 | Tilman | 383/63 |

* cited by examiner

*Primary Examiner*—Jes F. Pascua
(74) *Attorney, Agent, or Firm*—Larry L. Huston; Stephen T. Murphy; David M. Weirich

(57) ABSTRACT

The present invention provides a flexible storage bag having an opening, a closure system for the opening, and a closure indicator. The closure indicator provides an audibly detectable signal upon closure, and optionally opening, of the closure system. The closure system may provide a seal which is preferably closed by a translatable slider as is known in the art. The translatable slider may intercept protuberances causing the protuberances to produce a snap or clicking sound as the slider passes over the protuberances. Alternatively, the closure indicator may be an adhesive bond which is disrupted by the translation of the slider. The closure indicator is passive, meaning that no additional action beyond the ordinary and commonly accepted movement of the slider is required to produce the audible signal.

3 Claims, 4 Drawing Sheets

FLEXIBLE STORAGE BAG WITH AUDIBLE CLOSURE INDICATOR

CROSS REFERENCE TO RELATED APPLICATIONS

This application claims the benefit of U.S. Provisional Application Nos. 60/150,028, filed on Aug. 20, 1999, 60/150,029, filed on Aug. 20, 1999, and 60/150,030, filed on Aug. 20, 1999.

FIELD OF THE INVENTION

The present invention relates to closures such as those commonly employed on flexible storage bags, particularly those suitable for use in the containment and protection of various items including perishable materials.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. Many commercially available flexible storage bags utilize mechanical interlocking seals to achieve closure of the bag opening, and some such bags additionally employ a sliding mechanical closure to improve the ease of opening and closing mechanical interlocking seals. With either type of mechanical interlocking seal, there remains the issue of determining whether complete closure has in fact been completed across the mouth of the bag to achieve the desired completion of the closing operation.

Accordingly, it would be desirable to provide a closure which provides for a positive indication of when a complete closure has been achieved.

SUMMARY OF THE INVENTION

The present invention provides a flexible storage bag having an opening, a closure system for the opening, and a closure indicator. The closure may comprise interlocking seals closable by a slider. The slider may cause release of encapsulated gas by rupturing pockets containing encapsulated gas. Alternatively, the closure indicator may comprise resiliently deformable protuberances. The resiliently deformable protuberances are disposed in the path of the slider, whereby the slider intercepts and resiliently deforms the protuberances upon translation. After the slider has intercepted and released the protuberances, they snap back into position producing the audible signal.

Alternatively, the closure indicator may comprise a mechanical seal having a rack disposed at least partially along the length of the mechanical seal. The slider has a resiliently mounted ratchet finger which intercepts the rack upon translation. The ratchet finger produces an audible sound in response to intercepting the individual teeth of the rack. Alternatively, the slider may comprise a pinion gear mounted on the slider which engages the rack and rotates in response to translation of the slider. The resilient ratchet finger may engage the pinion gear and produce the audible signal in response to engagement and release by the teeth of the pinion gear.

In yet another embodiment, the closure indicator may comprise materials distorted in response to being intercepted by translation of the slider and thereby produce an audible sound upon distortion.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
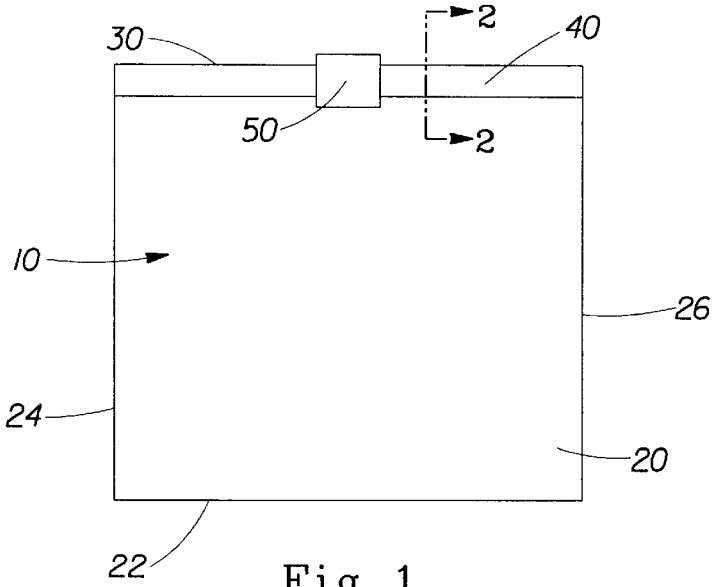
FIG. 1 is an elevational view of a flexible storage bag employing a closure indicator in accordance with the present invention.

FIG. 1 depicts a presently preferred embodiment of a flexible storage bag 10 according to the present invention. In the embodiment depicted in FIG. 1, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure system 40 located adjacent to edge 30 for sealing edge 30 to form a fully-enclosed container or vessel. Bags such as the flexible storage bag 10 of FIG. 1 can be also constructed from a continuous tube of sheet material, thereby eliminating side seams 24 and 26 and substituting a bottom seam for fold line 22. The mechanical closure system 40 includes an interlocking mechanical seal of any suitable conventional design, and may optionally include a sliding mechanical element (slider) 50 as shown in the embodiment of FIG. 1 for opening and closing the interlocking mechanical seal. The sliding mechanical closure may be of suitable conventional design for the type of interlocking mechanical seal employed. Interlocking mechanical seals may include opposed ribs having complementary interlocking shapes, an opposing rib/channel pair with complementary interlocking shapes, or other configurations such as those known in the art.

Figure 2:
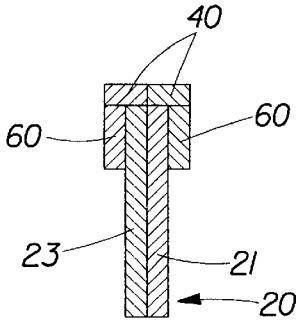
FIG. 2 is a fragmentary elevational sectional view of a closure indicator in accordance with the present invention.
Figure 3:
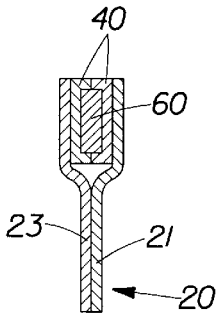
FIG. 3 is a fragmentary elevational sectional view of another closure indicator in accordance with the present invention.
Figure 4:
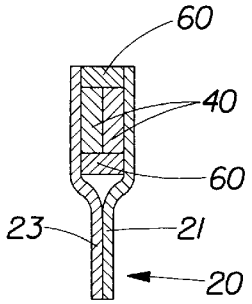
FIG. 4 is a fragmentary elevational sectional view of a further closure indicator in accordance with the present invention.

FIGS. 2–4 are cross-sectional views of a bag according to FIG. 1 illustrating in greater detail the audible closure indicator 60 of the present invention.

As shown in FIG. 2, the audible closure indicator 60 is positioned substantially adjacent to the closure 40. In this embodiment, the closure 40 is formed at the upper edge 30 of each opposing side 21, 23 of the bag body 20 and the audible closure indicator 60 is on the outwardly facing surfaces of the sides 21, 23 close enough to closure 40 such that operation of the closure 40 manually or with the use of optional slider 50 activates the audible closure indicator to produce sound indicating successful closure operation. The audible closure indicator may be positioned on both sides of the bag as shown, or may be positioned on only one side.

FIG. 3 shows another embodiment of an audible closure indicator, wherein the audible closure indicator 60 is positioned within and/or between elements of the closure 40 for activation similar to the embodiment of FIG. 2. Another permutation is shown in FIG. 4, wherein the audible closure indicator 60 is positioned above and/or below the closure 40 but between the sides 21, 23 of the bag body 20.

The audible closure indicators of the present invention, such as shown in FIGS. 2–4, operate via the release of an encapsulated gas, most commonly air, concurrently with the closure operation. This release of gas through an existing aperture or an aperture formed during the closure process creates a specific sound the consumer may associate with successful closure operation. The encapsulated gas may be entrapped in a pressurized state or may become pressurized during the closure operation such that it exits through the aperture with sufficient velocity to produce sound. The "report" of the released gas may take place as one or more discrete sounds during the closure process or upon closure completion, or may produce a substantially continuous sound during the closure process.

Figure 5:
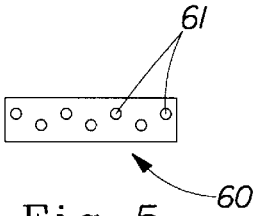
FIG. 5 is a fragmentary elevational view of one material suitable for use as a closure indicator in accordance with the present invention.
Figure 6:
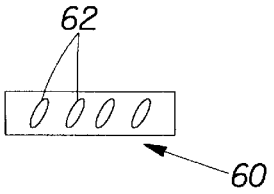
FIG. 6 is a fragmentary elevational view of another material suitable for use as a closure indicator in accordance with the present invention.
Figure 7:
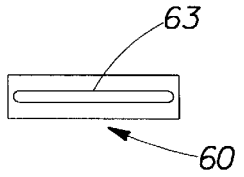
FIG. 7 is a fragmentary elevational view of a further material suitable for use as a closure indicator in accordance with the present invention.

FIGS. 5–7 depict representative configurations for an audible closure indicator 60 in accordance with the present invention and, more particularly, representative approaches for the arrangement of encapsulated gas within the material.

FIG. 5 depicts one embodiment of a material suitable for use as an audible closure indicator 60 in accordance with the present invention. In this embodiment, the encapsulated gas is contained within one or more, preferably a plurality of, discrete bubble-like compartments 61 within the material. These compartments may be distributed randomly or regularly throughout the material, or may be grouped into zones or patterns, and may project outwardly beyond the general plane of the material or may be contained within the material below its outer surface. The material may be designed such that the material ruptures in one or more locations to release the gas from the compartments when compressed such as during the closure operation, or discrete apertures may be formed such that the compartments are in fluid communication therewith. The compartments with the encapsulated gas therein may be formed such as by entraining air or other gas as the material is formed, or by forming a laminate of multiple material elements at least one of which is shaped so as to trap air therebetween. Delamination of laminated materials may function to perform the gas release function. Suitable methods for forming embossments in thin film materials suitable for trapping air between them and a material laminated thereto are described in commonly-assigned U.S. Pat. No. 5,518,801, issued to Chappell, et al. on May 21, 1996, and U.S. Pat. No. 5,650,214, issued Jul. 22, 1997 in the names of Anderson et al., the disclosures of which are hereby incorporated herein by reference.

FIG. 6 depicts another embodiment of a material suitable for use in accordance with the present invention. In this embodiment, a plurality of elongated compartments 62 are formed in the material, similarly to the description above. FIG. 7 is similar, but depicts a single elongated compartment 63, which may extend substantially along the length of the closure so as to provide a sustained sound as gas is progressively released during the closure operation. Compartments may be arranged as desired with regard to the proportion of the closure process completed or may be distributed throughout.

Figure 8:
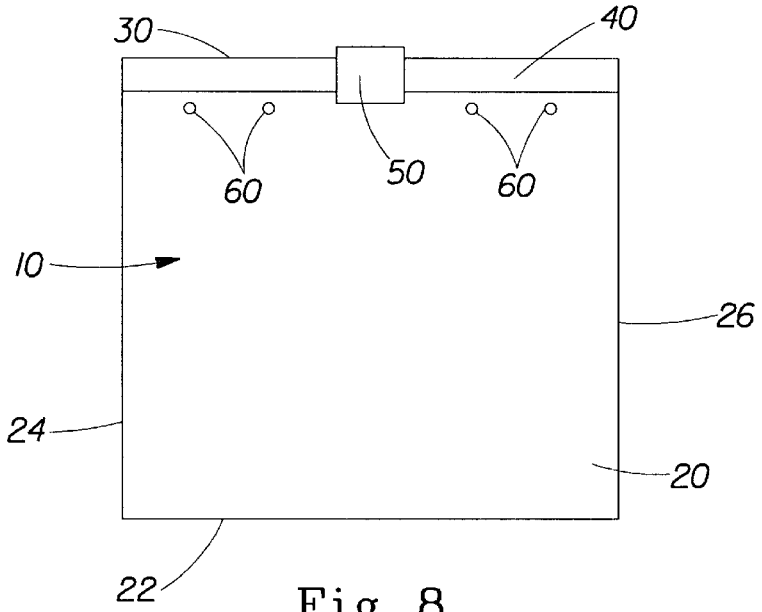
FIG. 8 is an elevational view of a flexible storage bag employing a closure indicator in accordance with the present invention.

FIG. 8 depicts a presently preferred embodiment of a flexible storage bag 10 according to the present invention. In the embodiment depicted in FIG. 8, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure system 40 located adjacent to edge 30 for sealing edge 30 to form a fully-enclosed container or vessel. Bags such as the flexible storage bag 10 of FIG. 8 can be also constructed from a continuous tube of sheet material, thereby eliminating side seams 24 and 26 and substituting a bottom seam for fold line 22. The mechanical closure system 40 includes an interlocking mechanical seal of any suitable conventional design, and may optionally include a sliding mechanical element (slider) 50 as shown in the embodiment of FIG. 8 for opening and closing the interlocking mechanical seal. The sliding mechanical closure may be of suitable conventional design for the type of interlocking mechanical seal employed. Interlocking mechanical seals may include opposed ribs having complementary interlocking shapes, an opposing rib/channel pair with complementary interlocking shapes, or other configurations such as those known in the art. In the embodiment of FIG. 8, at least one closure indicator 60, and preferably a plurality of closure indicators 60, are provided substantially adjacent to the closure 40.

As shown in FIG. 8, the closure indicator 60 is positioned substantially adjacent to the closure 40. In this embodiment, the closure 40 is formed at the upper edge 30 of each opposing side 21, 23 of the bag body 20 and the closure indicator 60 is on the facing surfaces of the sides 21, 23 close enough to closure 40 such that operation of the closure 40 manually or with the use of optional slider 50 activates the closure indicator to produce audible and/or tactile feedback to the consumer indicating successful closure operation. The closure indicator may be positioned on both sides of the bag as shown, or may be positioned on only one side. The closure indicator is placed and configured such that translation of a slider element, engagement of mechanical interlocking seal elements, and or the forces exerted by the consumer during either of the foregoing provides an audible signal to the consumer of successful closure operation.

FIGS. 9–12 illustrate in greater detail one closure indicator 60 of the present invention shown in FIG. 8.

Figure 9:
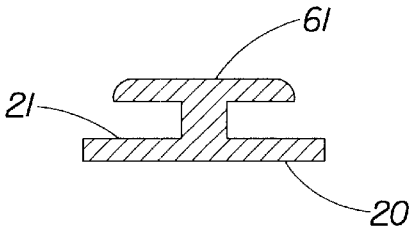
FIG. 9 is an elevational sectional view of one element of a closure indicator in accordance with the present invention.
Figure 10:
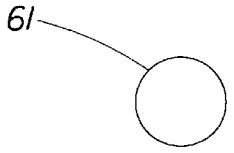
FIG. 10 is a top plan view of the element of FIG. 9.
Figure 11:
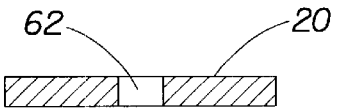
FIG. 11 is an elevational sectional view of another element complementary to that of FIG. 9 of a closure indicator in accordance with the present invention.
Figure 12:
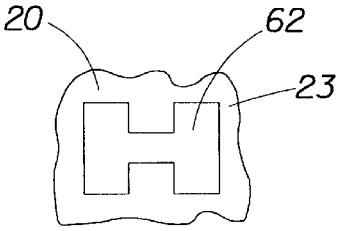
FIG. 12 is a top plan view of the element of FIG. 11.

In the embodiment of FIGS. 9 and 10, one portion of the closure indicator 60 comprises a mushroom-shaped protrusion 61 which extends inwardly from one side 21 of the bag body 20 facing toward the other side 23 of the bag body 20. FIGS. 11 and 12 correspondingly depict the mating portion, aperture 62, formed in the other side 23 of the bag body 20. The aperture 62 includes at least one protrusion, preferably a plurality of protrusions, extending inwardly which are sized and disposed so as to be able to grip the stem of the protrusion 61 when inserted therethrough. If in fact a closure indicator involves an aperture through the wall of the bag body 20, as shown in FIGS. 11 and 12, such a breach of bag wall integrity preferably occurs beyond the closure system if bag wall integrity is important for preservation of items within.

Figure 13:
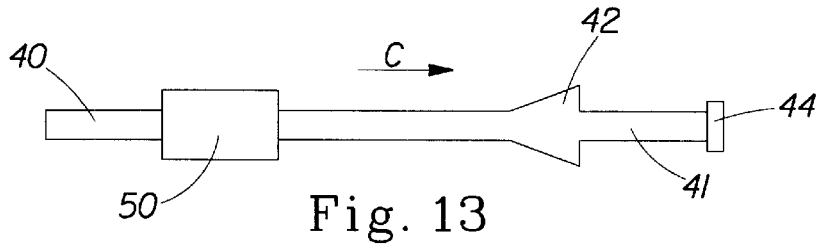
FIG. 13 is an elevational view of another closure indicator in accordance with the present invention.
Figure 14:
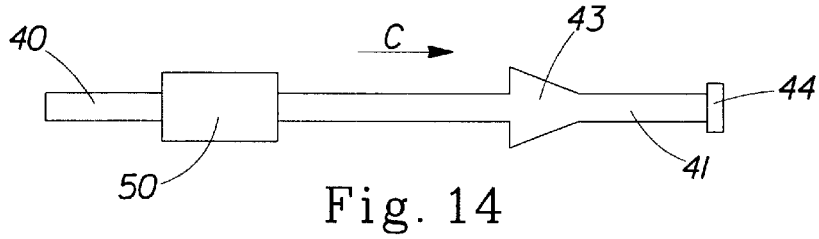
FIG. 14 is an elevational view of another embodiment of a closure indicator simlar to FIG. 13.

FIGS. 13 and 14 depict another embodiment of a closure indicator in accordance with the present invention. In these Figures, a slider 50 is associated with a track 41 which preferably forms part of the closure system but may be a separate element. The slider moves in the direction "C" to accomplish closure of the bag, and in approaching the end stop 44 in the fully closed condition passes over an enlargement 42 or 43 in the track which is designed and configured so as to increase the resistance of slider movement passing thereover and also sufficiently abrupt so as to produce a "report" or sound when the slider 50 clears the enlargement and reaches the end of its travel. The selection of suitable materials may also aid in producing such a sound as the slider 50 and enlargement return to their unstressed condition.

Figure 15:
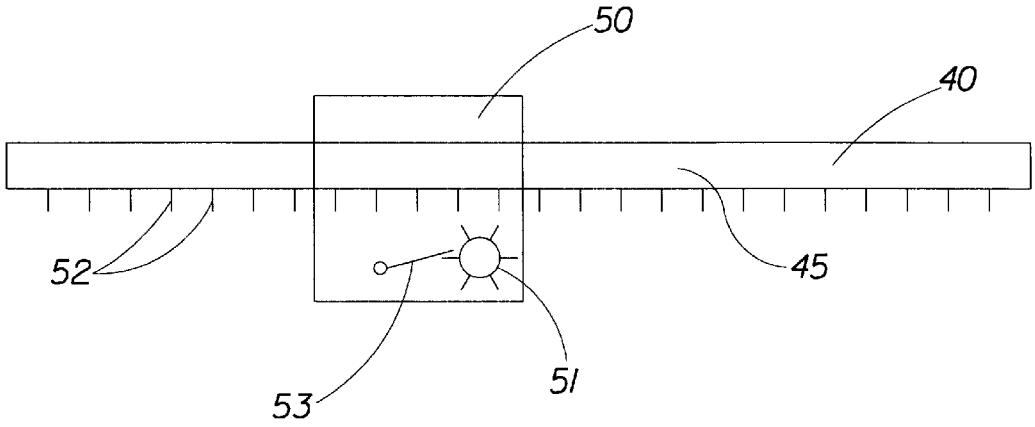
FIG. 15 is an elevational sectional view of a further embodiment of a closure indicator in accordance with the present invention.

FIG. 15 illustrates another embodiment of a closure indicator in accordance with the present invention. The closure indicator includes a track 45 with a plurality of toothed projections 52 extending therefrom, which may form part of the closure or may be a separate element. The slider 50 includes a toothed wheel 51 which engages the toothed projections 52 when the slider is translated relative to the track 45 to rotate the wheel. The teeth on the wheel 51 also engage a resiliently-mounted ratchet finger 53 which produces an audible clicking sound as the slider 50 is translated across the bag to provide an audible signal.

If desired, in a simpler embodiment, the tooth wheel 51 may be eliminated. In such an embodiment, a resiliently-mounted ratchet finger 53 directly engages the toothed projections 52. By being resiliently-mounted, the ratchet finger 53 flexes in response to the undulations of the toothed projections 52. By having the ratchet finger 53 flex, as opposed to the material forming the bag body 20 flex, as occurs in the prior art, greater control is obtained. Specifically, the slider 50 may be injection molded with an integral ratchet finger 53, or a separate ratchet finger 53 joined thereto, with greater precision than can occur when utilizing the material forming the bag body 20 to form the audible sound.

Figure 16:
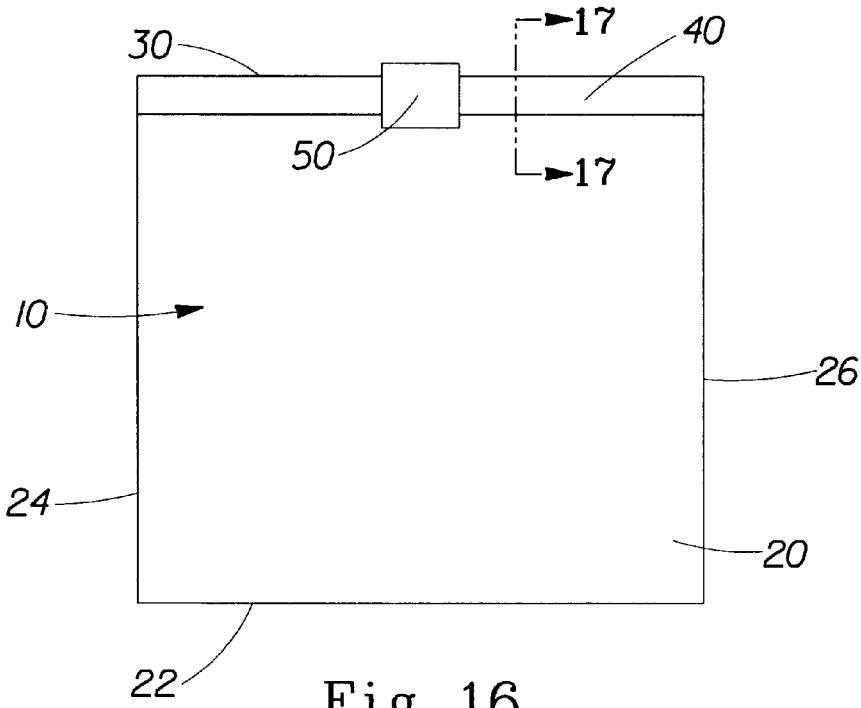
FIG. 16 is an elevational view of a flexible storage bag employing a closure indicator in accordance with the present invention.

FIG. 16 depicts a presently preferred embodiment of a flexible storage bag 10 according to the present invention. In the embodiment depicted in FIG. 16, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure system 40 located adjacent to edge 30 for sealing edge 30 to form a fully-enclosed container or vessel. Bags such as the flexible storage bag 10 of FIG. 16 can be also constructed from a continuous tube of sheet material, thereby eliminating side seams 24 and 26 and substituting a bottom seam for fold line 22. The mechanical closure system 40 includes an interlocking mechanical seal of any suitable conventional design, and may optionally include a sliding mechanical element (slider) 50 as shown in the embodiment of FIG. 16 for opening and closing the interlocking mechanical seal. The sliding mechanical closure may be of suitable conventional design for the type of interlocking mechanical seal employed. Interlocking mechanical seals may include opposed ribs having complementary interlocking shapes, an opposing rib/channel pair with complementary interlocking shapes, or other configurations such as those known in the art.

Figure 17:
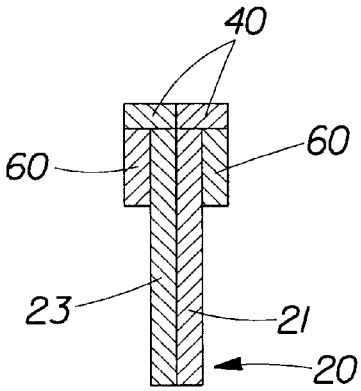
FIG. 17 is a fragmentary elevational sectional view of a closure indicator in accordance with the present invention.
Figure 18:
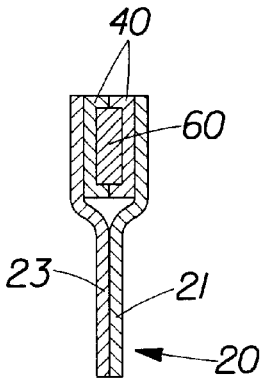
FIG. 18 is a fragmentary elevational sectional view of another closure indicator in accordance with the present invention.
Figure 19:
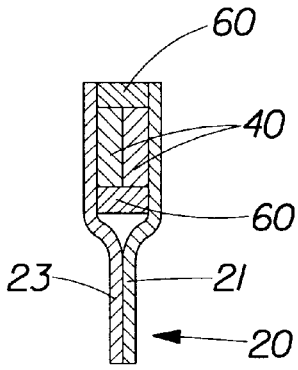
FIG. 19 is a fragmentary elevational sectional view of a further closure indicator in accordance with the present invention.

FIGS. 17–19 are cross-sectional views of a bag according to FIG. 16 illustrating in greater detail the closure indicator 60 of the present invention.

As shown in FIG. 17, the closure indicator 60 is positioned substantially adjacent to the closure 40. In this embodiment, the closure 40 is formed at the upper edge 30 of each opposing side 21, 23 of the bag body 20 and the closure indicator 60 is on the outwardly facing surfaces of the sides 21, 23 close enough to closure 40 such that operation of the closure 40 manually or with the use of optional slider 50 activates the closure indicator to produce audible and/or tactile feedback to the consumer indicating successful closure operation. The closure indicator may be positioned on both sides of the bag as shown, or may be positioned on only one side.

FIG. 18 shows another embodiment of an closure indicator, wherein the closure indicator 60 is positioned within and/or between elements of the closure 40 for activation similar to the embodiment of FIG. 17. Another permutation is shown in FIG. 19, wherein the closure indicator 60 is positioned above and/or below the closure 40 but between the sides 21, 23 of the bag body 20.

The closure indicators 60 of the present invention, such as shown in FIGS. 17–19, operate via the selection of specific materials to produce and audible and/or tactile indication the consumer may associate with successful closure operation.

One such class of materials of interest is resealable adhesives, such as pressure sensitive (hot melt or other types) adhesives commonly known in the art. In such an embodiment, the adhesive material is positioned such that during the closure operation the translation of a slider element or engagement of mechanical interlocking seal elements forces apart two adhesively-bonded overlying layers of material so as to produce a sound. The adhesive material would once again be bonded during opening of the closure so as to be ready for another closure sequence of operation. The resistance provided by the separating adhesive material would also provide a tactile signal to the consumer that he or she was in fact applying force in a region which was manipulating elements of the closure.

Another class of materials of interest is cohesives, i.e., adhesive-like materials which only exhibit adherent properties to themselves. Contact cement would be one illustrative example of a cohesive material. Other representatives materials include rubber cement, thermoplastic elastomers such as styrene-diene copolymers exemplified by a product sold under the trade name KRATON® by Shell, and other autoadhesive materials such as soft, low modulus materials having a Shore A hardness of less than or equal to about 80. Cohesive materials applied to a slider and to the surfaces of the bag and closure over which it translates would provide additional resistance to translational movement (i.e., friction), increasing the effort required to manipulate the closure and thereby providing a tactile signal to the consumer. Additionally, depending upon the properties of the cohesive material, it may also be possible to design the closure system to produce a rubbing or other sound as cohesive surfaces are translated relative to one another to provide an audible signal of successful closure operation.

Another class of materials of interest is materials which produce an audible "crinkly" sound when they are flexed and distorted during the course of the closure operation. Representative materials include paper, high density polyethylene (HDPE), high molecular weight high density polyethylene (HMW-HDPE), polypropylene (PP) and copolymers thereof, polystyrene and copolymers thereof, nylons, polyesters (PET and PETG), polycarbonate and other materials having a flexural modulus of at least 100,000 psi when in the form of a thin film. These materials may be provided as a narrow strip adjacent the closure, while the remainder of the bag is constructed of the desired conventional material. The closure indicator is placed and configured such that translation of a slider element, engagement of mechanical interlocking seal elements, and or the forces exerted by the consumer during either of the foregoing distorts the strip of "crinkly" material so as to produce a sound, thereby providing an audible signal of successful closure operation.

A further category of suitable materials is three-dimensional materials which face outwardly toward the hand of the consumer during interlocking of mechanical elements and/or manipulation of a mechanical slider. These materials may be exposed or protected below another layer such as an opposing surface of the bag. In the latter protected configuration, the overlying surface could be utilized to limit the tactile impression of the underlying texture until a sufficient force was applied to the closure area, while in the former exposed configuration mere contact would reveal the tactile impression. The three-dimensional materials may be of any suitable structure for providing an outwardly-facing surface comprising one or more projections, and may include ribs, posts, suction cups, hooks, grooves, or a more random texture like sandpaper. Once again, the closure indicator is placed and configured such that translation of a slider element, engagement of mechanical interlocking seal elements, and or the forces exerted by the consumer during either of the foregoing provides a tactile signal to the consumer of successful closure operation.

Yet another category of materials suitable for use as a tactile closure indicator is materials which are formed from a material diverse from conventional bag materials (and thus diverse from the remainder of the bag) which exhibit a diverse tactile impression from such conventional bag materials. Such materials would exhibit a smoother, rougher, more rubbery, more slippery, more cloth-like, or otherwise diverse "feel" in comparison with the remainder of the bag, such that the consumer when coming into contact with them would recognize that they are exerting forces and manipulating elements in the correct fashion to achieve successful closure operation. Representative materials include: "soft touch polypropylene (such as that exemplified by the product sold under the trade name ADFLEX® by Montell; thermoplastic elastomers such as styrene-diene copolymers (exemplified by KRATON® sold by Shell), polyester-polyolefin copolymers (exemplified by HYTREL® sold by DuPont), polyamide-polyester copolymers (exemplified by PEBAX®), polypropylene-based materials (exemplified by SANTOPRENE® sold by Advanced Elastomer Systems), and polyurethanes (exemplified by ESTANE® sold by B.F. Goodrich); plasticized polyvinyl chloride (PVC); ethylene copolymers such as ethylene-vinyl acetate (EVA) with greater than about 18% vinyl acetate, ethylene methylacrylate (EMA), ethylene ethyl acrylate (EEA), and ethyleneoctene (metallocene) with greater than about 18% octane; and very low density polyethylene (VLDPE).

Various compositions suitable for constructing the flexible storage bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. Patents which are illustrative of the state of the art with regard to flexible storage bags similar in overall structure to those discussed above but of the types currently available are U.s. Pat. No. 5,554,093, issued Sep. 10, 1996 to Porchia et al., and U.s. Pat. No. 5,575,747, issued Nov. 19, 1996 to Dais et al.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible plastic bag having an opening defined by two edges being closable by a mechanical closure, said mechanical closure comprising interlocking seals closable by a slider, said slider being translatable along said edges, translatable along said mechanical seal, said bag further comprising a closure indicator providing an audible signal in response to translation of said slider, said closure indicator comprising encapsulated gas.

2. A flexible bag according to claim 1, wherein said closure indicator comprises encapsulated gas, said encapsulated gas being juxtaposed with said slider, wherein said slider causes release of said encapsulated gas upon translation.

3. A flexible bag according to claim 2, wherein said flexible bag is generally planar and has first and second opposed edges, said first edge and said second edge being associated with opposed ends of said mechanical seal, said encapsulated gas being juxtaposed with said second edge of said flexible bag, wherein said slider is translated in the direction from said first edge to said second edge to effect closure of said bag.

* * * * *